US006199549B1

(12) United States Patent
Yerkes

(10) Patent No.: US 6,199,549 B1
(45) Date of Patent: Mar. 13, 2001

(54) TRANSPORTABLE VENDING CART WITH WOOD-FIRED OVEN

(75) Inventor: William D. Yerkes, Columbus, OH (US)

(73) Assignee: Vengo 2000, Columbus, OH (US)

( * ) Notice: Subject to any disclaimer, the term of this patent is extended or adjusted under 35 U.S.C. 154(b) by 0 days.

(21) Appl. No.: 09/035,719

(22) Filed: Mar. 5, 1998

Related U.S. Application Data

(60) Provisional application No. 60/039,864, filed on Mar. 5, 1997.

(51) Int. Cl.[7] ..... F24B 1/00

(52) U.S. Cl. ..... 126/276; 126/8

(58) Field of Search ..... 126/5, 8, 12, 13, 126/34, 3, 101, 276; 110/241; 106/632; 501/130

(56) References Cited

U.S. PATENT DOCUMENTS

| | | | | |
|---|---|---|---|---|
| D. 398,432 | * | 9/1998 | Yerkes | D34/20 |
| 1,254,721 | * | 1/1918 | Needham et al. | 126/9 R |
| 2,329,589 | | 6/1943 | Carter | 106/55 |
| 2,423,231 | | 7/1947 | Esnault-Pelterie | 106/67 |
| 3,738,350 | | 6/1973 | Stiles | 126/19 R |
| 3,939,295 | | 2/1976 | Robertson et al. | 428/539 |
| 4,108,138 | * | 8/1978 | Petin et al. | 126/8 |
| 4,432,798 | | 2/1984 | Helferich et al. | 106/38 |
| 4,438,755 | * | 3/1984 | Moffett | 126/34 |
| 4,474,165 | * | 10/1984 | Richardson | 126/8 |
| 4,683,151 | | 7/1987 | Hamaguchi et al. | 427/397.8 |
| 4,780,142 | | 10/1988 | Rechter | 106/84 |
| 4,802,921 | | 2/1989 | Motoki | 106/18.12 |
| 5,268,031 | | 12/1993 | Lassiter | 106/634 |
| 5,474,606 | | 12/1995 | Twardoska et al. | 106/632 |

FOREIGN PATENT DOCUMENTS

| | | | | |
|---|---|---|---|---|
| 629635 | * | 11/1927 | (FR) | 126/34 |

* cited by examiner

*Primary Examiner*—Ira S. Lazarus
*Assistant Examiner*—Sara Clarke
(74) *Attorney, Agent, or Firm*—Shawnell Williams Esq.; Kegler, Brown, Hill & Ritter

(57) ABSTRACT

The present invention relates to a transportable, wood-fired oven, which can either be utilized alone or disposed upon, installed, attached or otherwise mated to a housing or framework, of a cart of curved or agonic or convex design, said design permitting greater cart maneuverability and greater work area, and which oven can then be transported to a location having pedestrian traffic, such as street vending sites, or special events, for on-site preparation of foods at those locations.

7 Claims, 5 Drawing Sheets

TRANSPORTABLE VENDING CART WITH WOOD-FIRED OVEN

CROSS-REFERENCE TO RELATED APPLICATION

This application claims the benefit of U.S. Provisional application Ser. No. 60/039,864, filed Mar. 5, 1997.

BACKGROUND OF THE INVENTION

Many people like the taste imparted by a wood-fired oven. In fact, it appears that societal dining tastes and trends are leaning toward Continental cuisine. Restaurants offering new and varied dining experiences and tastes, from the sublime to the exotic, have flourished and prospered during the past decade or two. Among the tastes frequently sought after is that of food cooked or baked in a solid fuel oven, such as wood-fired oven baked breads and pizzas, as well as various other foods that can be prepared in a solid fuel, wood-fired oven. These ovens provide a unique cooking method and the fired gases and smokes let off by the solid fuels impart to the foods cooked in these ovens a unique taste obtained only from such ovens. Diners frequent restaurants whose menus include such wood-fired oven foods for the gustatory experience offered by these uniquely flavored foods, such as breads, pastas, pastries, poultries, fish, meats and pizzas.

A problem arises for the person who wishes to dine on foods cooked or baked in a solid fuel oven, but is not near a restaurant offering such foods, or does not have the time required to dine in a restaurant. The foods prepared in a solid fuel ovens, including wood-fired ovens, are best eaten when freshly prepared and cooked. Therefore, although many restaurants offer take-out or carry-out foods prepared in wood-fired ovens, the carry-out diner is unable to experience the freshly baked or cooked flavors available to in-restaurant diners. Frozen oven baked foods as well do not offer the true gustatory experience offered by freshly cooked wood-fired oven foods.

Workers on their lunch breaks often do not have the time to visit and dine in a restaurant or may just prefer to eat outside. Additionally, persons at outdoor events must typically rely on food vendors dispensing foods from carts for their dining experiences. Workers and event attendees, as well as others, who seek fresh, on-site wood-fired oven cooked or baked foods have been denied the experience either because of logistical difficulties or time restraints in going to a restaurant and ordering such foods.

Side walk vendors, while offering foods prepared on-site, do not offer wood-fired oven cooked foods. Current side walk vendors offer foods prepared on grills or ovens heated with natural gas flames, charcoal or electrically generated heat, but the relatively quick and flavor enhancing aspect offered by wood-fired heat is lacking in natural gas, charcoal or electric ovens or grills. Additionally, the utility requirement of electrically powered vending carts limits the operation of those carts to where such utilities are practicably available.

SUMMARY OF THE INVENTION

It is an object of the present invention to provide a portable solid fuel oven which can utilized alone or can be disposed upon, installed, attached or mated to a to a vending cart and which cart and oven can be transported to a location for on-site preparation of wood-fired oven foods at the location for consumption by persons wanting such foods, freshly prepared and at a location distant from a restaurant, yet be fast and convenient for customers wanting to eat foods prepared and flavored by such wood-fired, or other solid fuel-fired ovens.

Further, it is an object of the present invention to provide an oven fabricated or formed from a composition of materials which renders the oven resistant to cracking or damage caused by vibrational stress or shock forces, such as can be caused by highway or roads bumps, encountered by or applied to the oven during transport.

Further it is the object of the present invention to provide an oven in which is formed an oval, rounded or circular shaped gas escape aperture, set approximately between four (4) to eight (8) inches from the oven's access port, said shaped and positioned gas escape aperture providing for greater gas and smoke escape or venting through a chimney situated near the oven gas vent. The greater gas and smoke venting reduces the amount of smoke which typically escapes through the access port of other, conventional solid-fuel ovens with non-circular shaped gas vents that are positioned approximately one (1) to two (2) inches from the access port. As well, the circular aperture permits use of a shorter chimney stack than is required to be used on conventional solid fuel ovens.

Further, it is an object of the present invention to provide an oven whose heat source can cook foods quickly and can be utilized to heat water, held in a hot water storage tank or reservoir located within the cart upon which the oven is situated. Many community and state health agencies require that a food vending or preparation cart contain a hot water storage tank, in order that hot water be available for washing utensils and the hands of the food preparers. Current heating sources for hot water, for example natural gas or electric heat sources, add additional costs to cart food vending and require space on the vending or preparation cart be allocated for the heat source, thereby reducing the usable storage area within the cart. By utilizing the oven as the heat source for the hot water tank, space is made available for other items, such as additional foods which can be sold to customers and the costs of having to utilize additional fuels, such as natural gas or electric, is eliminated.

Further, it is an object of the present invention to provide a cart shaped or formed with an agonic, tapered, rounded, wedged, curved or convex frontal portion or area, which increases the transportability and maneuverability of the cart over current shaped carts which are utilized for food vending or preparation and which allows for use of shorter towing hitches than those that must be used on conventional carts. Additionally, the shape of the cart of the present invention provides an increased food preparation work surface and service counter area. The shape and structure of the cart also provide greater stability, support and/or balance to the cart when an oven is placed onto or attached to the counter area of the cart.

Further, it is an object of the present invention to provide a method for cooking foods in the portable, mobile solid fuel oven, which utilizes ingredients which permit foods to be cooked in the oven in a relatively short time period. It has been demonstrated to take less than two (2) minutes to cook foods, such as pizza, in the oven of the present invention, as opposed to six (6) to 15 or more minutes to cook the same foods in a conventional ovens utilizing gas or electric.

DETAILED DESCRIPTION OF THE INVENTION

Figure 1:
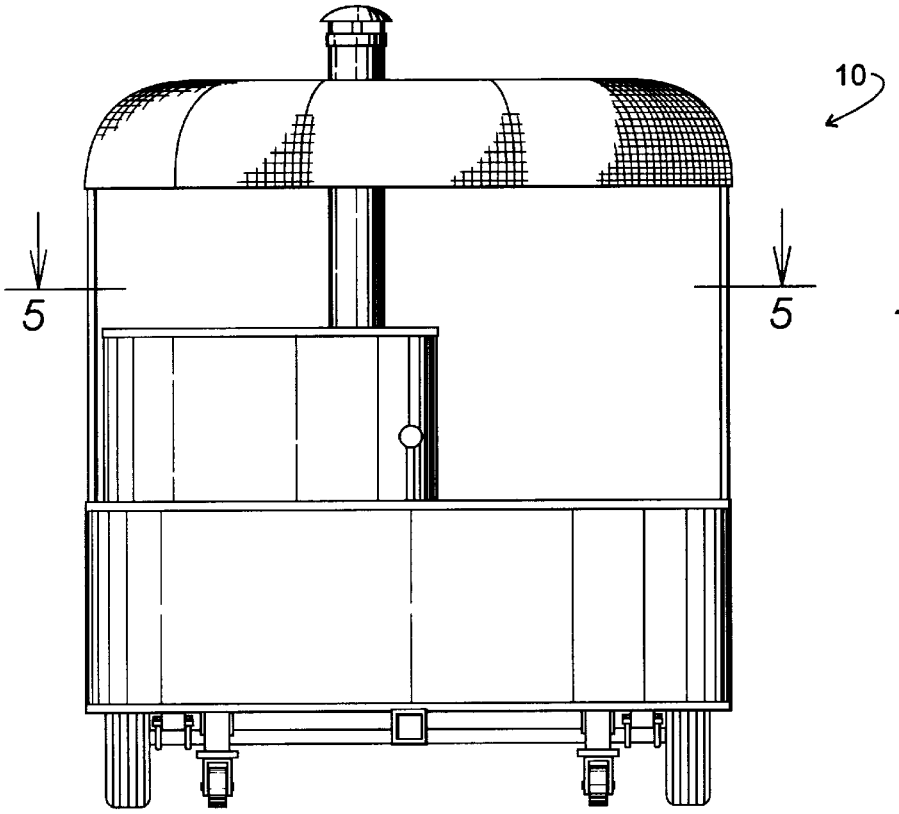
FIG. 1 is a front elevational view of the transportable vending cart according to the present invention.
Figure 2:
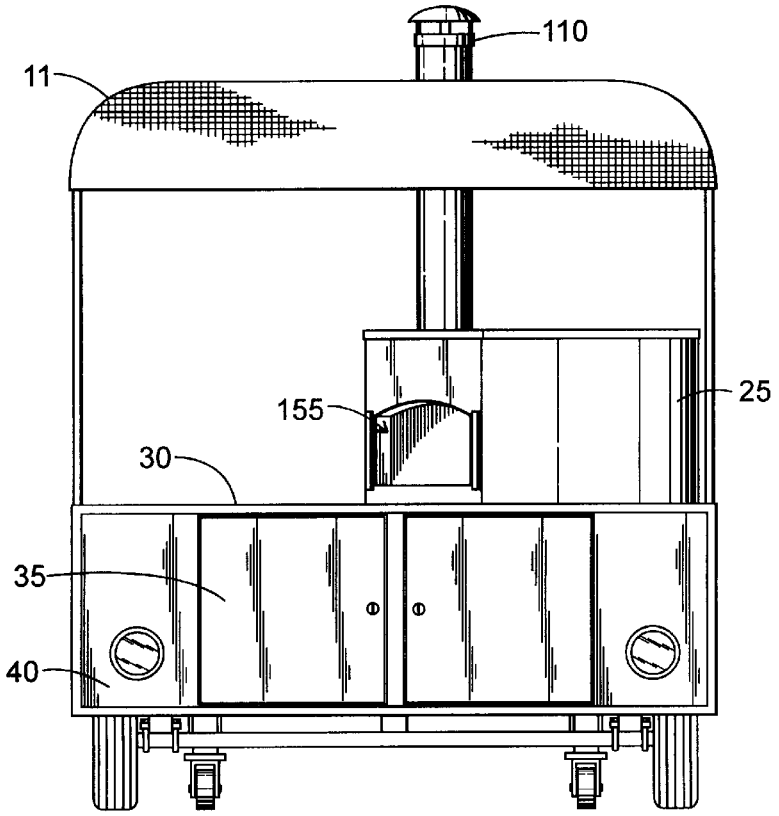
FIG. 2 is a rear elevational view of the transportable vending cart according to the present invention.
Figure 3:
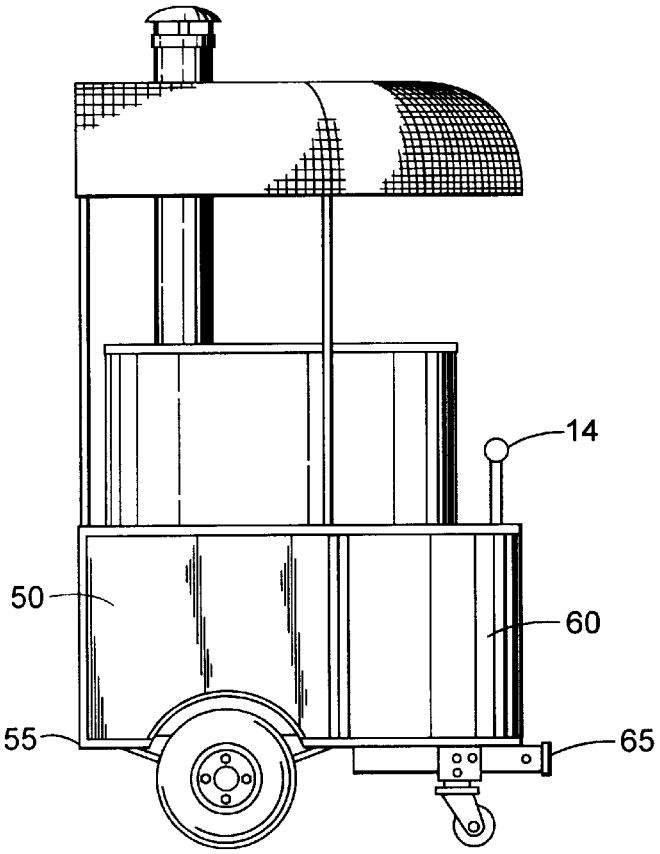
FIG. 3 is a left side elevational view of the transportable vending cart according to the present invention.
Figure 4:
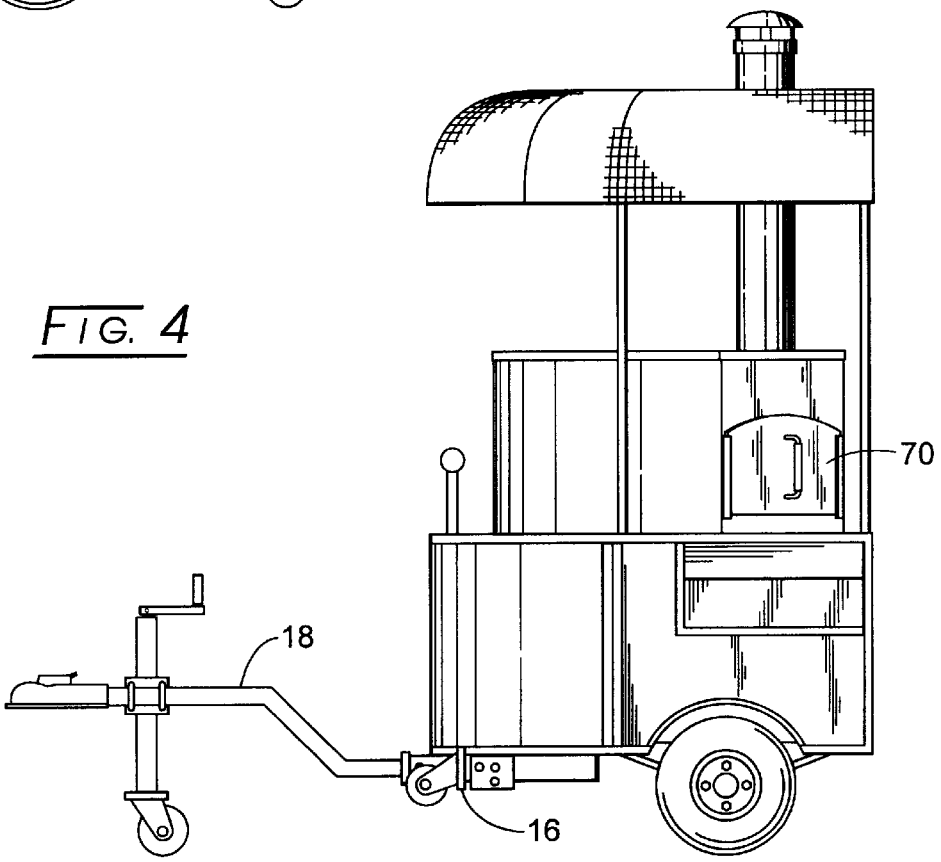
FIG. 4 is a right side elevational view of the transportable vending cart according to the present invention.
Figure 5:
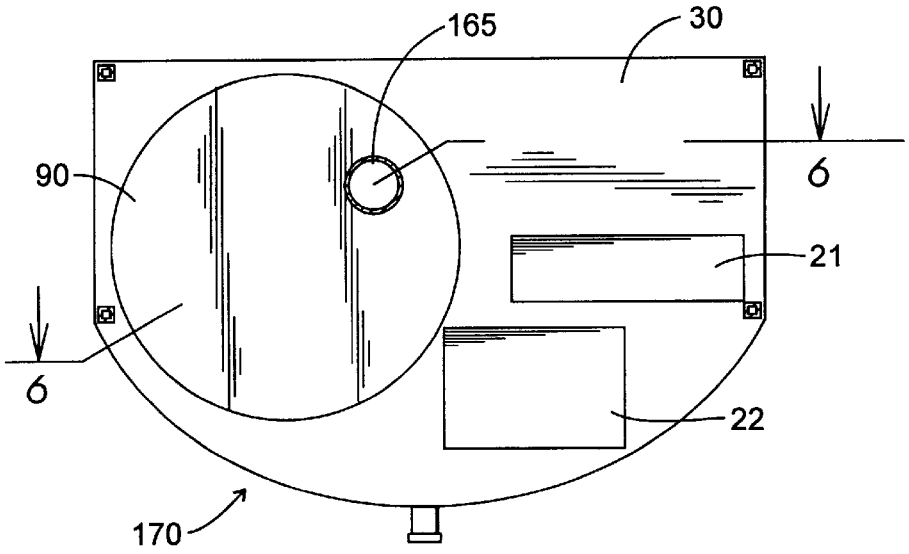
FIG. 5 is a top plan view taken through section 5—5 of FIG. 1 of the transportable vending cart according to the present invention.
Figure 6:
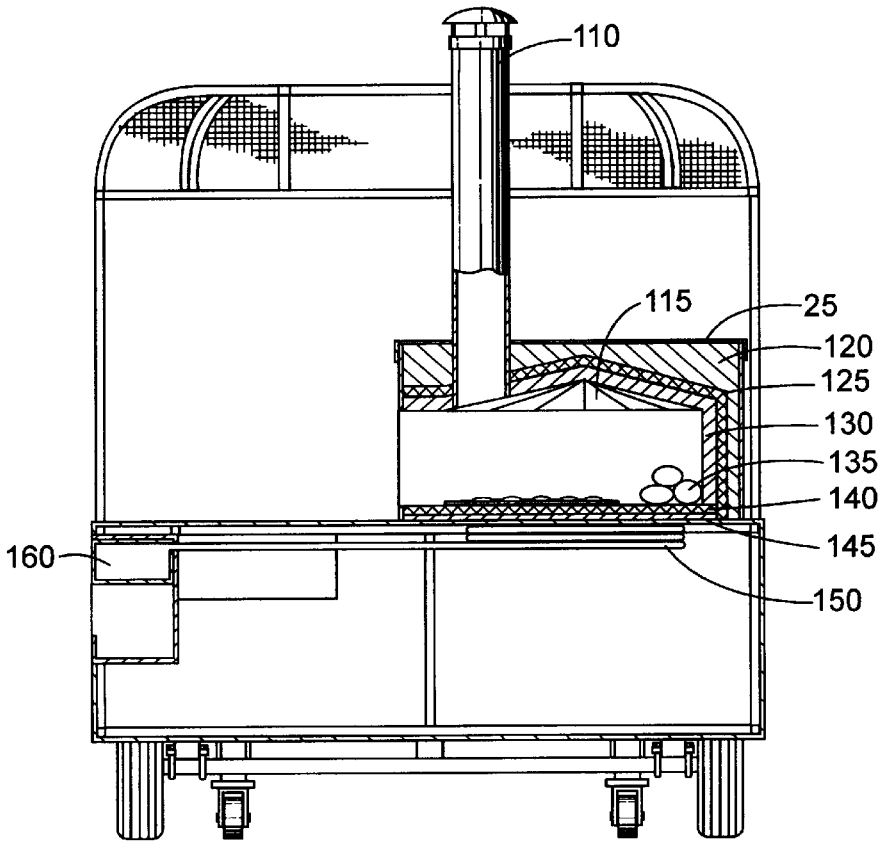
FIG. 6 is a cross-sectional view taken through section 6—6 of FIG. 5 of the transportable vending cart according to the present invention.
Figure 7:
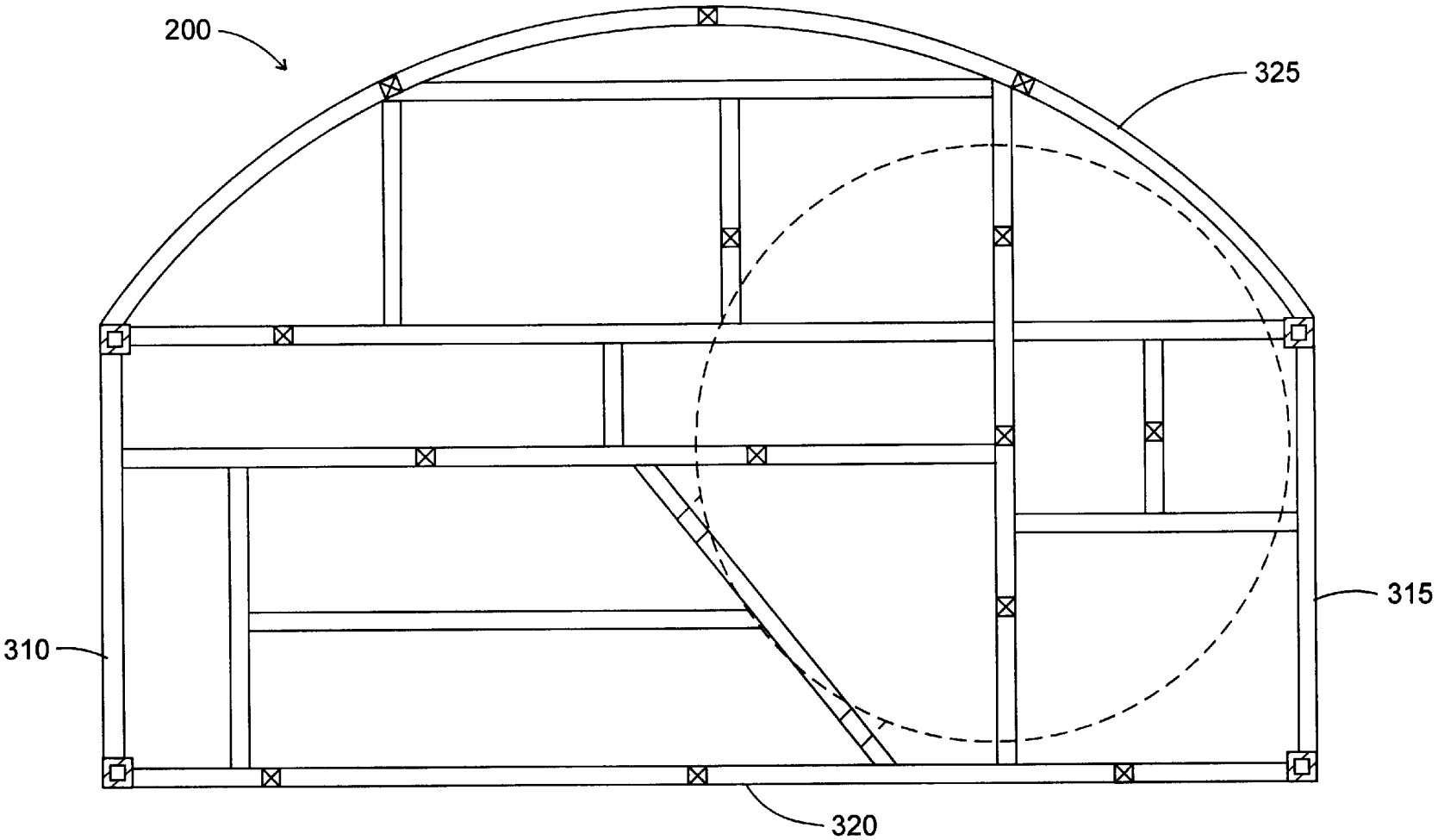
FIG. 7 is a top plan view of the top frame of the vending cart according to the present invention.
Figure 8:
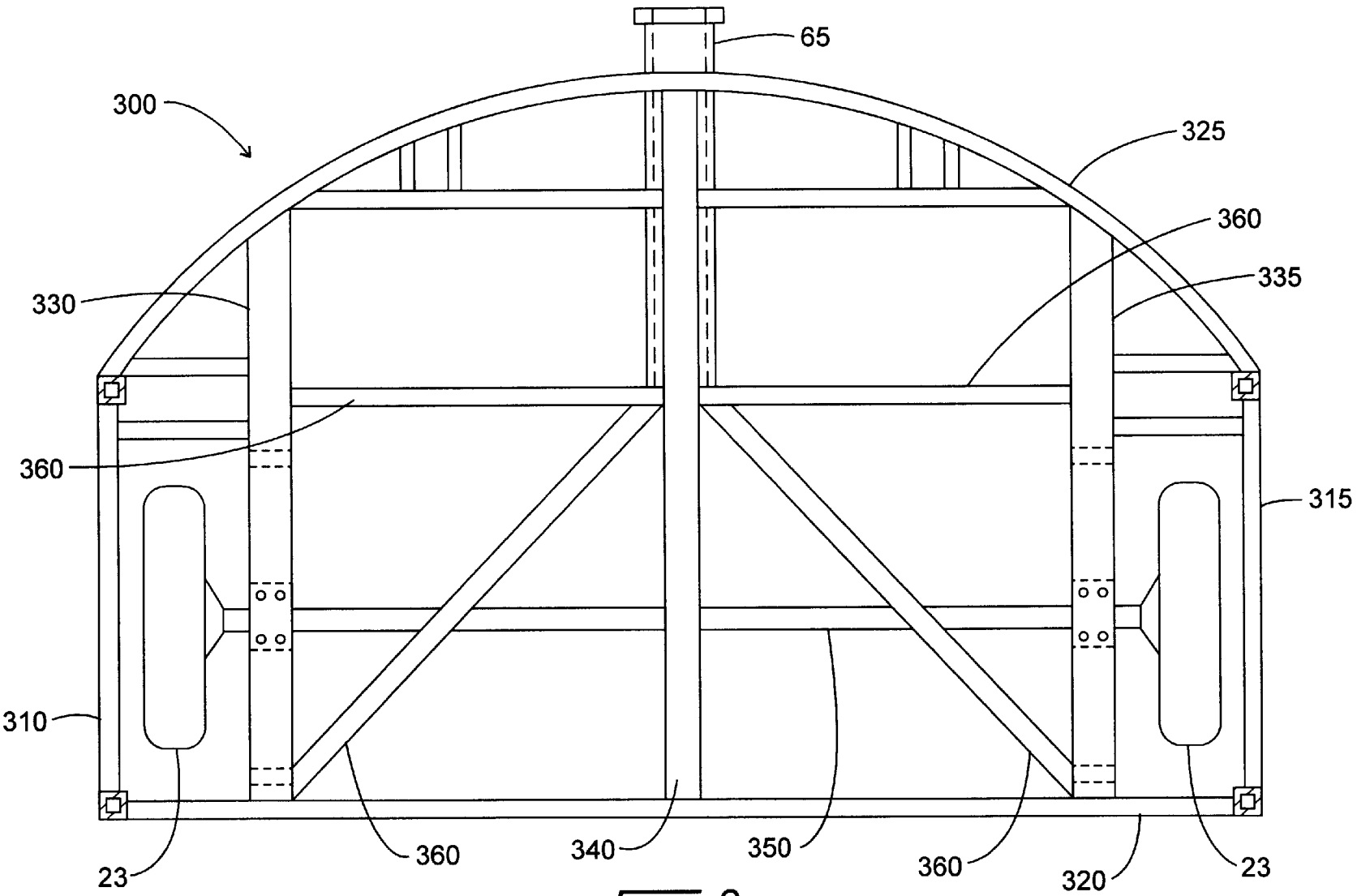
FIG. 8 is a bottom plan view of the bottom frame of the vending cart according to the present invention.

Although the best mode of carrying out the present invention is herein disclosed, the invention is not limited by the best mode disclosure, but relates to all aspects of the transportable wood-fired oven or transportable vending cart 10, herein disclosed, in FIGS. 1–8. The present invention provides a transportable wood-fired oven 90 for use with or without the disclosed, uniquely-shaped vending cart and which avoids the disadvantages of the prior art. These disadvantages include: non-portability of current wood-fired ovens; restricted gas venting from a wood-fired oven; lack of maneuverability of current vending carts; and cracking of conventionally fabricated ovens brought about by exposure of ovens to vibrational stress or shock, or rapidly charging elements, while being transported on highways or roadways.

The transportable wood-fired or other solid fuel oven 90 of the present invention is fabricated from materials using a design that enables the oven 90 to withstand peak temperatures approximating kiln temperatures of 2000° Fahrenheit ("F"). Additionally, the oven 90 is able to withstand wood-fired temperatures between 700° F. and 1200° F., i..e., those temperatures typically required to cook or bake foods inside of such ovens, for extended periods of time. Further, the reinforced composition of materials 130 used to fabricate the oven 90 are of sufficient strength and elasticity such that the oven 90 of the present invention is resistant to cracking and damage typically suffered by conventionally fabricated wood-fired ovens due to the vibrational stresses and shocks associated with transporting the cart on roadways while attached to a cart or otherwise transported.

Various materials can be utilized in the manufacture or fabrication of said invention, solid fuel oven 90, to include clays, silicates, inert materials, and water. One such novel reinforced composition of materials 130 used to manufacture this crack resistant oven 90 herein disclosed is as follows:

20% aluminosilicate

20% sodium silicate

50% clay

10% water inert material [0.023" diameter ×2" nominal metal wire segments]

A form or mold is fabricated, having a domed-shaped exterior and a generally round interior (with triangularly faceted roof sections) 115 cavity into which the oven compound comprised of the silicates, clay, water and inert reinforcing materials 130 are then mixed together into a suspension and then poured into the mold. The suspension is then pressed into place with a male mold member and allowed to dry. The exterior of the resulting oven 90 takes on the corresponding shape of the cavity, while the shape of the interior of the oven 90 corresponds to the shape of the male mold component. The oven 90 is formed having a front access port 155 having been formed into one of its walls and with an circular gas escape aperture or exhaust port 165 formed into the ceiling of the oven 90, which, in one embodiment of the invention, is located between four and eight inches behind the front access port. The inert wire included in the reinforced composition material 130, adds strength and resiliency to the oven 90 thus aiding its resistance to cracking under vibrational stress.

After sufficient time for drying and hardening, the form is removed and the oven 90 shell is removed. An outer shell, typically 2' to 4", of spray foam insulation 125 is applied to the oven 90 shell for thermal isolation purposes. A hearthstone 140 made from fire brick material is situated within the oven 90 and forms the oven floor. The hearthstone 140 is resistant to heat, and made for use in wood-fired, solid fuel and other formed ovens. It is the area upon which the solid fuel 135 is ignited and burned as well as the area on which the foods are cooked or baked.

The new oven 90 is then cured by allowing it to dry by repeated burnings of solid fuels 135 on the hearthstone 140 inside the new oven 90. After several cycles of burnings, the oven 90 is cured and ready for productive use. This novel process and composition results in an oven 90 that can be transported and towed on a roadway behind a vehicle while attached or disposed upon a cart while resisting vibrational stresses or shocks that cause cracking in other ovens. Further, the oven 90 formed or fabricated into a novel shape comprising a domed exterior surface combined with a planar, triangular plate or triangular plate/domed interior surface 115 provide for a faster and hotter cooking oven 90 than is found on conventional or rounded-domed solid fuel ovens. Fast cooking times are useful in the vending business where a vending customer expects to receive food ready for consumption in less than two minutes after placing an order, rather than the five or more minutes such cooking would require in conventional gas fired or electric type ovens.

Another novel feature of the invention is the gas escape aperture, or exhaust vent 165, which is formed into the oven 90 during fabrication, (as is the oven door 70 or front access port 155), which is set farther back than the non-circular apertures found on conventional wood-fired ovens. The shape and position of the gas escape aperture 165 permits a greater escape of gases and smoke through the gas escape aperture 165 and reduces the amount of gas and smoke escaping through the front access port 155, thus enhancing the flavoring of foods cooked in such ovens 90. The gas escape aperture 165 is formed as an oval, rounded or circular shape and is set approximately between four (4) and eight (8) inches from the oven's 90 front access port 155. This positioning and shape providing for greater gas and smoke escape or venting through a chimney 110 situated on top of the oven 90 gas escape aperture 165. The greater gas and smoke venting permitted by the novel gas escape aperture 165 or vent shape and position reduces the amount of smoke which typically escapes through the access port of other, conventional solid-fuel ovens which may be equipped with slotted or non-circular shaped gas vents that are positioned closer, i.e., approximately one (1) to two (2) inches from the access port. As well, the circular gas escape aperture 165 permits use of a shorter chimney 110 stack than is required to be used on conventional solid fuel ovens. The reduction of smoke escaping from the front access port 155, the increased draft created through the gas escape aperture 165 into the chimney 110 stack and the resulting ability to reduce the size of the chimney 110 stack are all novel and desirable features for use with a transportable vending cart 10. A shorter chimney 110 is more portable than those currently required to draw smoke through a non-circular gas vent, and the reduction in smoke permitted to escape from the front access port 155 provides a cleaner and less noxious environment for food preparers and customers alike. Additionally, the front access port 155 may be fitted with a cover to close off the front access port 155 during transport, storage or otherwise.

Some community and state health agencies require that a food vending or preparation cart contain or otherwise be equipped with a hot water storage tank or hot water source for sanitary purposes such as for washing utensils and the hands of the food preparers. Current heating sources or units for preparation and/or storage of hot water, e.g., natural gas or electric heat sources, add additional costs and complexity to the business of cart food vending, plus take up valuable cart space that could otherwise be used to carry or store food products for sale. The present invention provides another novel feature of an oven 90 whose heat source can not only cook foods quickly but can also be utilized to heat water which is stored in a hot water reservoir 160 located within the cart upon which the oven 90 is situated. By utilizing the available heat energy generated from the oven 90 to heat the water contained in an on-board hot water reservoir 160, the costs of fabricating the vending cart as well as the ongoing costs of food preparation are substantially reduced, thereby increasing the earning sales and earnings potential of the cart food vendor.

An oven housing 25 is provided to cover the oven 90 and keep the oven heat within the oven housing 25. At the same time, the oven housing 25 prevents the extreme oven temperatures from reaching the food preparers, customers or other persons that come in proximity to the cart or ignited oven 90. The oven housing 25 may be constructed of sheet metal or other heat or burn resistant material formed as any shape which can cover the oven 90, however, the best mode herein disclosed is that of a cylinder or box fabricated or formed to cover and house the oven 90. This creates a space between the foam insulation 125 and the interior surfaces of the oven housing 25, wherein about and within such space is situated, placed or otherwise disposed, loose insulating material 120 of sufficient heat resistance and insulating properties such that if internal oven temperatures reach 1000° F., external oven housing 25 temperatures remain at or near temperature which are neither harmful to touch or uncomfortable to stand in proximity thereto.

The oven housing 25 having a space or housing vent or hole that is situated or spaced to correspond or line-up to the oven's unique gas escape vent or aperture 165 as the oven housing 25 is placed covering the oven 90. A insulated chimney 110 stack made of the same or similar materials as the oven housing 25 is connected or attached about it or through the space forming the housing vent. As explained earlier, the unique and novel shape and placement of the oven's 90 gas escape aperture 165 permits use of a chimney 110 stack less than six feet in height, as opposed to taller chimney stacks required in conventional ovens using slotted or non-circular gas vents.

The oven 90, oven housing 25 and chimney 110 can be utilized as a free standing unit or can be disposed upon or otherwise attached to a vending cart of such novel design that the weight of the solid fuel oven is secured, stabilized, balanced or otherwise supported by the cart. The novel cart provides a convenient method of transporting and utilizing the oven 90 for on-site food preparation in a solid fuel oven, such as office lunch crowd service or servicing customers at events distant from a restaurant.

The invention includes a transportable vending cart shaped or formed with an agonic, tapered, rounded, wedged, curved or convex frontal portion or area 170, which increases the transportability and maneuverability of the cart over current shaped carts which are utilized for food vending or preparation and allows for use of shorter towing hitches 65 than those that must be used on conventional carts. Additionally, the rounded frontal portion of cart 170 provides a greater or increased food preparation work surface 30 and service counter area. The shape and fabrication of the cart also provide greater stability, support and/or balance to the cart when an oven 90 is placed onto or attached to the cart's work surface 30.

The cart is comprised a top frame 200 and a bottom frame 300. The top frame 200 is comprised of tubular struts whose perimeter corresponds with said bottom frame 300 and which supports panels or plates each having at least four edges; a top panel or plate having a first side which faces upward and forms a worksurface 30 and service counter area and provides space or base for placement of the oven 90, and having a second side opposite the first side; two side panels, side panel "A" 50 and side panel "B" 50, each having a first side facing outward and a second side opposite the first, are placed parallel to one another and such that their second sides face inward and facing each other; a bottom panel having a first side facing downward and a second side opposite the first facing inward parallel to and facing the second side of the top panel 30 and slotted sufficiently to form a space between the side panels 50 and the bottom panel to permit placement and rotation of a tire within the slots; a front panel 60 formed as an agonic, convex, or curved plate with a first side facing forward and outward and a second side opposite the first facing inward; and a rear panel 40 having a first side facing backward and a second side opposite the first facing inward and generally parallel to and facing the second side of the front panel 60. The panel edges are disposed or otherwise affixed or attached together by attachment means, such as welding or bolting, in such a manner that a closed shape or box structure is formed, having a cavity interior. The rear panel 40 has an opening formed into it such that access to the interior cavity is achieved through the rear opening. Said cavity may be used for storage purposes. Rear panel 40 access doors may be attached to the cart in order that items stored within the cart cavity may be secured.

The top frame 200 of the cart is disposed, situated or attached by attachment means to a bottom frame 300 comprising a support means, whereby the top frame 200 is secured to the bottom frame 300, providing a stable cart that is able to be towed or otherwise transported or taken to a location and is also capable of supporting the weight of the oven 90.

The bottom frame 300 may be fabricated or manufactured or formed from tubular metal of sufficient strength to support a vendor's cart with oven 90 while being transported to a location or while in stationery use. The fabricated frame as disclosed in its best mode is comprised of tubular metal struts fabricated to form the shape of the bottom panel of the top frame 200; tubular side struts, first side strut 310 and second side strut 315, each having a first end and second end opposite the first end; a tubular rear strut 320 having a first end and a second end opposite the first; a tubular front strut 325 formed or shaped into substantially the same or similar agonic or curved shape of the front panel of the top frame 200; said struts are disposed or otherwise affixed or attached together by attachment means, such as welding or bolting, in such a manner to form the shape of the bottom panel of the top frame 200.

The first end of the rear strut 320 is attached to the first end of first side strut 310 and the second end of the rear strut is attached to the first end of second side strut 315. The first end of the front strut 325 is attached to the second end of first side strut 310 and the second end of the front strut is attached to the second end of second side strut 315. The front strut 325 is positioned such that it convex "bow" points outward or forward, matching the "bow" of the front panel. The frame formed by the joining of said struts provides a sufficient basic base or support upon which the top frame 200 of the cart can be disposed or placed and can support the weight of the cart and oven 90.

A pair of tubular bracing struts, first bracing strut 330 and second bracing strut 335, each having a first end and a second end opposite the first, are secured to the interior surfaces of the bottom frame 300. The first ends of the bracing struts 330 and 335 are attached to the inwardly facing surface of the front strut 325 and the second ends of the bracing struts are attached to the inwardly facing surface of the rear strut 320, in a position directly across and opposite the corresponding bracing strut first end attachment points. First bracing strut is situated near and parallel to first side strut 310, forming after said attachment, a space providing sufficient area for a wheel to be situated and to rotate within such space. Second bracing strut 335 is situated near and parallel to second side strut, forming after said attachment, a defined space bordered by the facing surfaces of the struts, providing sufficient area for a wheel to be situated and to rotate within such space.

A central tubular bracing hitch strut 340, having a first end and a second end opposite the first, is positioned and affixed or otherwise secured, fastened or attached to the top frame 200 in such a manner that the second end of the hitch is affixed to the inner facing surface or area of the rear strut 320 and positioned equidistant from the attachment points of first and second side struts 310 and 315 to the rear strut, and the first end of the hitch strut 340 is positioned flush with the exterior surface or area, disposed within, or affixed to an area interior of the front strut 325, and positioned equidistant from the attachment points of first and second side struts to the front strut.

The hitch strut 340 and bracing struts 330, 335 can be fitted with an axle device 350, to which can be attached wheels, said wheels situated within the wheel rotation space defined between the bracing struts and their corresponding side struts 310, 315. The bottom frame 300 can be strengthened with additional support struts or braces or other reinforcing means as required to obtain rigidity and strength sufficient to support and permit to be hauled on it the top frame 200 and oven 90. Additional supports or wheels can be attached to the frame to provide stability and maneuverability to the cart while in stationery use. The central hitch 340 strut forms a hitch attachment surface to which a hitch device can be attached, permitting the cart to be towed, hauled or otherwise transported to a location. The novel shape and design of the cart permit the use of a shorter tow hitch 65 (approximately three feet) than must typically be used on conventional carts (approximately six feet), permitting greater maneuverability, portability, mobility, and transportability of the cart.

It is an object of the present invention to provide a method for cooking foods, such as pizza, in the transportable wood-fired oven 90, utilizing ingredients which permit foods to be cooked in the oven in less than about two (2) minutes as opposed to about six (6) to 15 minutes or more cook time in a conventional gas, charcoal or electric oven.

A method of using the cart is disclosed as follows:

1. Transporting the cart and oven to a location for serving customers;
2. Igniting the solid fuel inside the oven, heating the oven, and pushing the fuel to the side or back of the oven;
3. Freshly preparing a high yeast content or gas filled dough or food for cooking in the oven;
4. Placing the gas filled food, which permits a shorter cooking time in the oven, into the oven;
5. Cooking the food and removing it onto the curved work cart; and
6. Serving the food to customer/consumers of such food.

High yeast content doughs permit the dough to become fast rising and filled with more gases than conventional yeast content doughs. The fast rising dough gives a thinner crust to pizza, thus permitting a faster cooking time and additionally permitting a more complete cooking of the food from top to bottom than can be accomplished with conventional doughs in conventional wood-fired or other solid fuel ovens.

Disclosed is the present invention, which relates to a transportable wood-fired oven 90, which can be utilized alone or can be disposed upon, installed, attached or otherwise mated to a housing or framework, or to a cart of curved or agonic or convex design, said design permitting greater cart maneuverability and work area, and which oven 90 can then be transported to a location for on-site preparation of foods at the location.

What is claimed is:

1. A transportable solid fuel oven, comprising:

a heating surface for preparing food;

a reinforced composition material, which consists essentially of aluminosilicate, sodium silicate, clay, water and inert material, operatively configured to absorb vibrational stress provided with faceted roof sections enclosing said heating surface;

heat insulation surrounding the outer surface of said reinforced composition material; and an oven housing with an access port and a gas vent enclosing said heat insulation, and solid fuel on said heating surface for providing heat thereto.

2. The reinforced composition material of claim 1 wherein the aluminosilicate comprises 20% of the reinforced composition material.

3. The reinforced composition material of claim 1 wherein the sodium silicate comprises 20% of the reinforced composition material.

4. The reinforced composition material of claim 1 wherein the clay comprises 50% of the reinforced composition material.

5. The reinforced composition material of claim 1 wherein the water comprises 10% of the reinforced composition material.

6. The reinforced composition material of claim 1 wherein the inert material consists of metal wire.

7. The transferable solid fuel oven of claim 1 wherein the oven is attached to a vending cart.

* * * * *